US011121488B2

(12) United States Patent
Kumar et al.

(10) Patent No.: US 11,121,488 B2
(45) Date of Patent: Sep. 14, 2021

(54) CONNECTOR ASSEMBLY

(71) Applicants: TE Connectivity India Private Limited, Bangalore (IN); TE Connectivity Italia Distribution S.r.l., Turin (IT)

(72) Inventors: P.K. Senthil Kumar, Bengaluru (IN); Ugo Aime, Poirino (IT)

(73) Assignees: TE Connectivity India Private Limited, Bangalore (IN); TE Connectivity Italia Distribution S.r.l., Turin (IT)

( * ) Notice: Subject to any disclaimer, the term of this patent is extended or adjusted under 35 U.S.C. 154(b) by 0 days.

(21) Appl. No.: 16/787,556

(22) Filed: Feb. 11, 2020

(65) Prior Publication Data

US 2020/0259279 A1 Aug. 13, 2020

(30) Foreign Application Priority Data

Feb. 11, 2019 (IT) ..... 102019000001883

(51) Int. Cl.
*H01R 12/58* (2011.01)
*H01R 4/24* (2018.01)

(52) U.S. Cl.
CPC ..... *H01R 12/585* (2013.01); *H01R 4/24* (2013.01)

(58) Field of Classification Search
CPC ..... H01R 12/585; H01R 12/718
See application file for complete search history.

(56) References Cited

U.S. PATENT DOCUMENTS 5,700,167 A 12/1997 Pharney et al.
9,287,635 B2 * 3/2016 Caveney ..... H01R 13/6469
10,276,955 B2 * 4/2019 Lybrand ..... H01R 9/2416
2007/0293094 A1 12/2007 Aekins
2017/0155203 A1 * 6/2017 Goto ..... H05K 1/11

FOREIGN PATENT DOCUMENTS

JP 2007166290 A 6/2007

OTHER PUBLICATIONS

European Search Report, dated Jun. 16, 2020, 9 pages.
Italian Search Report and Written Opinion, dated Sep. 26, 2019, 10 pages.
Abstract of JP2007166290(A), dated Jun. 28, 2007, 1 page.
TE Connectivity, Introduction Press-In Connections ACTION PIN and Multispring Contacts for many years Compliant ACTION PIN Contacts have proven their Reliability in the Automotive Industry Multispring II ACTION PIN Multispring Introduction, Apr. 1, 2010, XP055626550, Retrieved from the Internet: URL:/https://www.dalroad.com/wp-content/uploads/2015/12/ENG_CS_1654370_Press_Fit_Conn 0911-2.pdf (retrieved on Sep. 26, 2019), pp. 31-6-pp. 31-10.
N/a: "MAG-MATE Connector With Multispring Pin", Tyco Electronics Corporation, Jan. 1, 2013, XPO55347158, Retrieved from the Internet: URL: http://datasheet.octopart.com/1247003-2-TE-Connectivity-datasheet-14918754.pdf (retrieved on Feb. 17, 2017), p. 1-2.

* cited by examiner

*Primary Examiner* — Ross N Gushi
(74) *Attorney, Agent, or Firm* — Barley Snyder

(57) ABSTRACT

An assembly includes a circuit carrier having a first surface and a second surface opposite to the first surface, a first sub-assembly detachably connected to the first surface of the circuit carrier, and a second sub-assembly detachably connected to the second surface of the circuit carrier. The circuit carrier has an electrically conductive lead interconnecting the first sub-assembly and the second sub-assembly.

11 Claims, 2 Drawing Sheets

CONNECTOR ASSEMBLY

CROSS-REFERENCE TO RELATED APPLICATION

This application claims the benefit of the filing date under 35 U.S.C. § 119(a)-(d) of Italian Patent Application No. 102019000001883, filed on Feb. 11, 2019.

FIELD OF THE INVENTION

The present invention relates to a connector assembly and, more particularly, to a connector assembly for electrical devices.

BACKGROUND

As the number of electrical appliances increases, the use of small electrical motors also increases. Motors are typically incorporated into appliances such as vacuum cleaners, kitchen appliances, and any other power accessory used in home or business.

Magnetic wires are typically connected to terminals having insulation displacement slots. The terminals have two insulation displacement slots that cut through the tough outer varnish coating on the magnetic wires providing good electrical connection to the magnetic wire. The terminal can either be connected to a plug terminal, for example by a leaf spring contact or, alternatively, be connected to a receptacle terminal, for example, by an integral tab contact extending in the opposite direction of the insulation displacement slots.

Quick disconnects have been used by several different industries for more than 70 years with applications ranging from appliances to automotive wire harnesses, and including high-temperature designs, electric motors and power supplies controls. These terminals continue to be the standard for wiring electrical components since they remain unsurpassed in meeting the basic mechanical and electrical requirements of many applications.

In the past, typical wire range demand was between 0.2 and 2.0 mm diameter expressed in American Wire Gauge units [AWG 32 and 12]. Today's market also requires connections with fine wire (below 0.18 mm diameter, AWG 33) and large wire (above 3.0 mm diameter, AWG 9). Fine wire is utilized to reduce costs and also to comply with more compact design requirements. Therefore, not only the wire, but also the connection system, must have smaller dimensions to fit in areas where space is a premium.

At the other end of the scale, there is ever-increasing demand for low voltage power across many different applications. Of course, the lower voltages require higher current to deliver the required power, and larger wire is then necessary to carry the higher electrical current. The growth of applications using low voltage power is a steady, undeviating trend.

Another trend that continues to gain momentum, regardless of wire size, is a focus on innovation to effectively manage assembly costs while improving quality and consistency in the connection process. Above all, wire connections and terminations must be reliable. With the high risks of field failures, as well as the possibility of damage to reputation and customer relations, original equipment manufacturers (OEMs) are placing a priority on serving customers with high quality products. Higher quality products and processes can translate into lower costs for the OEMs.

Typical termination technologies are welding and soldering processes. While effective, these thermal processes can be difficult to control. They also require high temperatures that may damage the wire or components, and they require time-consuming mechanical or chemical processes to strip the magnet wire.

To better meet different technological demands different connection technologies must be investigated that will allow to reduce the risks of failure and that will allow engineers to design reliable products that perform well.

For magnetic terminals to interconnect with a circuit carrier, various types of lead connection have been provided, such as poke-in latches for directly receiving the wire, tabs for receptacle terminals, posts for wrapping wire thereabout, wire barrels or solder tabs. Contacts of this type have performed admirably and offer many advantages. However, with these prior art terminals for connecting magnetic wires to lead wires, it has been difficult to effectively connect the magnetic wires to harnesses and the like, which are used in appliances and other such devices.

Electronic connectors are frequently used in automotive electronics and telecommunication equipment. Due to the harsh application environments, fretting wear is one of the commonly seen causes of their premature failures. Fretting induces wear and corrosion, which could cause the gradual loss of normal contact force and increase of electrical contact resistance between a contact pair.

Therefore, as the industry becomes more and more sophisticated, it becomes necessary to provide electrical contacts that further enhance the assembly processes of components and allows for ease of repair and replacement. In addition, as the complexity of the electrical appliances and the like increases, it is beneficial to connect the motor and components in series through the use of harnesses. However, due to the configuration of the magnetic wire terminals, circuit carrier, and the quick disconnects detachably affixed onto the circuit carrier, the connection of the harnesses to the terminals has been difficult.

SUMMARY

An assembly includes a circuit carrier having a first surface and a second surface opposite to the first surface, a first sub-assembly detachably connected to the first surface of the circuit carrier, and a second sub-assembly detachably connected to the second surface of the circuit carrier. The circuit carrier has an electrically conductive lead interconnecting the first sub-assembly and the second sub-assembly.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
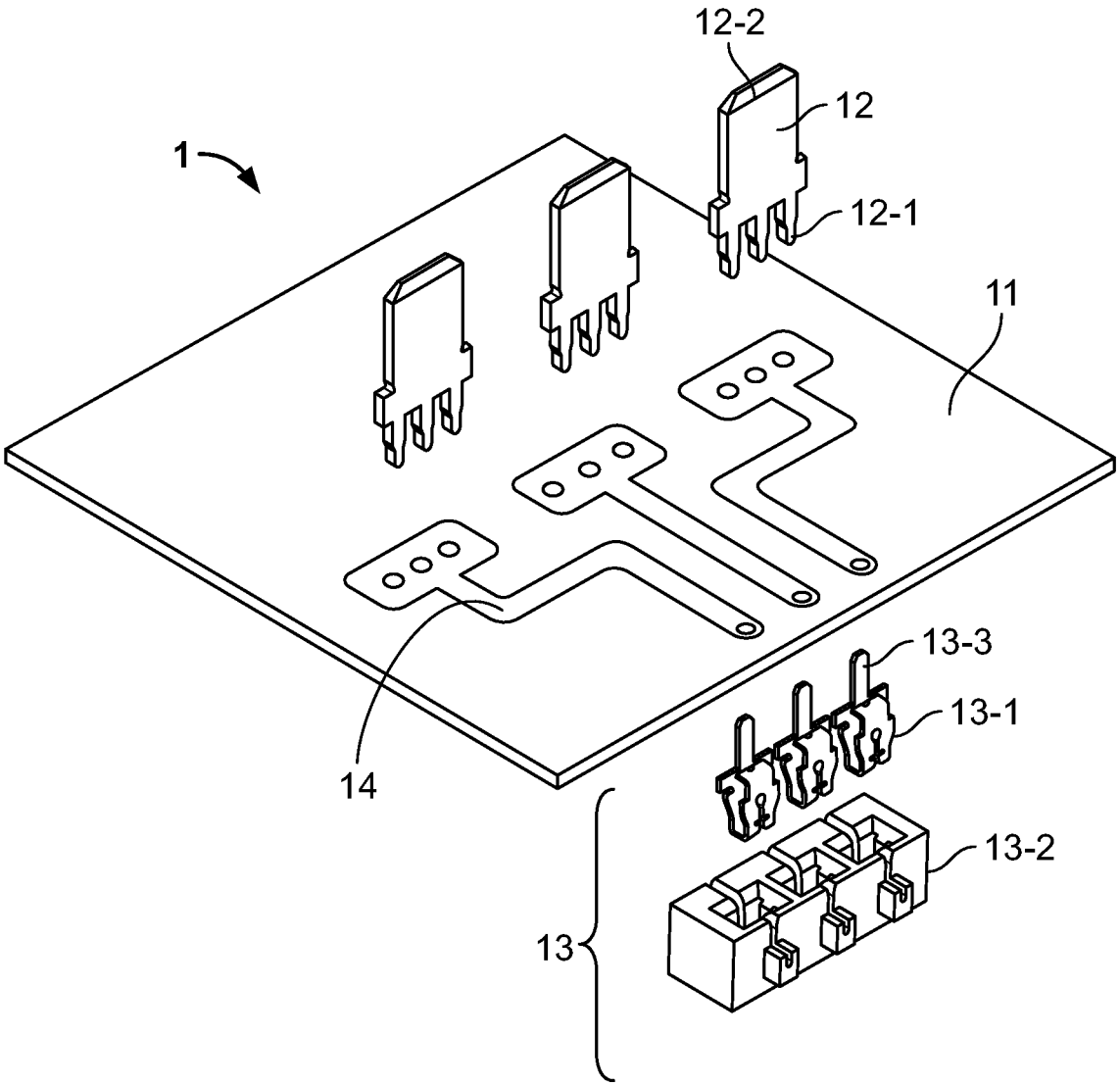
FIG. 1 is a perspective view of an assembly according to an embodiment in a detached state.

Exemplary embodiments are illustrated in the figures and described below, but the principles of the present disclosure may be implemented using any number of techniques, whether currently known or not. The present disclosure should in no way be limited to the exemplary implementations and techniques illustrated in the drawings and described below.

More specific embodiments of the present disclosure are described below. Note, however, that an excessively detailed description may be omitted. For example, a detailed description of an already well-known matter and a repeated description of substantially identical components may be omitted. This is intended to avoid unnecessary redundancies of the following description and facilitate understanding of persons skilled in the art. It should be noted that the inventors provide the accompanying drawings and the following description so that persons skilled in the art can fully understand the present disclosure, and that the accompanying drawings and the following description are not intended to limit the subject matters recited in the claims. In the following description, identical or similar constituent elements are given the same reference numerals.

Additional benefits and advantages of the disclosed embodiments will become apparent from the specification and drawings. The various embodiments and features of the specification and drawings may individually obtain the benefits and/or advantages, which need not all be provided in order to obtain one or more of such benefits and/or advantages. Unless otherwise specifically noted, articles depicted in the drawings are not necessarily drawn to scale.

Figure 2:
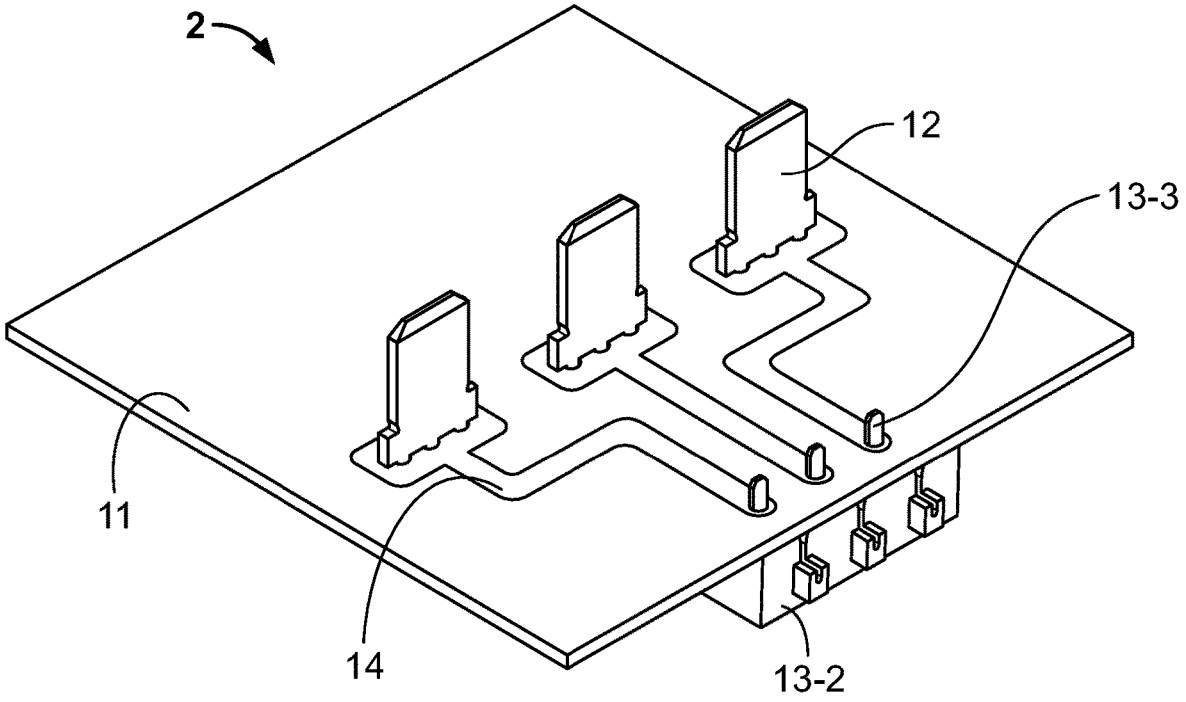
FIG. 2 is a perspective view of the assembly in an attached state.

An assembly according to an embodiment, as shown in FIGS. 1 and 2, comprises a first sub-assembly 12 and a second sub-assembly 13 which are arranged to detachably connect with a circuit carrier 11.

The first sub-assembly 12, as shown in FIGS. 1 and 2, includes a plurality of quick disconnects each having a fin shaped portion 12-2 and a plurality of compliant pins 12-1. The pins 12-1 can be of various types, for example, multispring, action-pin, eye of needle, etc. In an embodiment, the first sub-assembly 12 is a FASTON printed circuit board (PCB) terminal.

The second sub-assembly 13, as shown in FIGS. 1 and 2, includes a receptacle 13-1 and a cavity 13-2. The cavity 13-2 is adapted to receive conducting wires. The receptacle 13-1 includes a plurality of compliant pins 13-3 protruding perpendicular to the receptacle 13-1. The compliant pins 13-3 can be of various types, for example, multispring, action-pin, eye of needle, etc. In an embodiment, the compliant pins 13-3 are of the multispring type. In an embodiment, the receptacle 13-1 is a magnetic wire terminal. Conducting wires having an insulation are received in the cavity 13-2. The magnetic wire terminal 13-1 forces a selectively sharpened blade through the insulation, bypassing the need to strip the conductors of insulation by displacement before connecting the magnetic wire terminal 13-1 with the conducting wires. In an embodiment, the cavity 13-2 is a plastic material.

The receptacle 13-1 of the second sub-assembly 13 connects with the magnetic wire terminals received in the cavity 13-2 by displacing the insulation on the wires. Insulation displacing wire termination methods are used in a variety of applications. This termination technique is successfully used in many industries where mass termination of multiple contacts is cost effective. There exists in parallel—and completely equivalent—the two terms "Insulation Displacement Technology (IDT)" and "Insulation Displacement Connection (IDC)". Both terms describe the mating principle.

In insulation displacing wire termination methods, independent from the design of the electrically conductive part of a cable, the cable insulation is penetrated by needles or stripping shoulders such as a V- and/or U-shaped contact element and/or shifted in mating direction. At the same time the electrical connection between the cable and the contact element is made. The relative motion between contact element and cable, which is also called assembly process and necessary for the manufacturing of the electrical connection, will be realized in dependence on the design of the connector in different kinds: (a) with a fixed conductor the contact element is relatively moved to this conductor, (b) with a fixed contact element the conductor is inserted from above into the insulation displacement slot. On the one hand, this can be realized by a connector cover. On the other hand, there is the possibility of pressing the wire directly into the insulation displacement slot, whereby in this case (during assembly) the function of the above described cover is replaced in the manufacturing tool by special dies.

During the assembly process, the wire insulation is separated and the V-/U-shaped sides of the contact element are pressed against the conductor. Due to the high spring force of the insulation displacement slot, the conductor is slightly deformed and/or the stranded interconnection is realigned in its position. Thus, two opposite contact areas result in the insulation displacement slot. The contact areas between insulation displacement slot and conductor form a gas-proof connection, which prevent the penetration of corrosive gases into the electrical connection. In order to guarantee the gas density during the entire product life, the necessary contact pressure between cutting clearance and conductor must be always above a minimum value. The consequence of a declining gas density would be an increased transition resistance, which would lead again to increased temperatures in the connector. As this process-during constant electrical load-will build up, this would lead inevitably to a thermal overloading of the connector.

The first sub-assembly 12 is connected through the electrical leads 14 on the circuit carrier 11, shown in FIGS. 1 and 2, with the second sub-assembly 13. Each of the compliant pins 12-1, 13-3 of the first sub-assembly 12 and the second sub-assembly 13 are connected to a virgin area of the circuit carrier 11, engaging a plated through hole on the circuit carrier 11 and are electrically connected to the plated through hole.

In an embodiment, the circuit carrier 11 is a printed circuit board. The compliant pins 12-1, 13-3 are detachably attached to the circuit carrier 11 and thus offer a compact and automated solution for power transfer.

The first sub-assembly 12, in the embodiment shown in FIGS. 1 and 2, includes a plurality of flat tabs, such as FASTON tabs. The FASTON tabs are quick disconnects that have a fin 12-2 which can be mated with a mating contact to establish an electrical connection. The metallic terminals of the FASTON tab type or the like are crimped onto the metallic conductors of the mating contact and, being complementarily shaped, can therefore be mated; the mating contact, when mutually mated with FASTON tab, produces the electrical continuity that carries the electric current.

The assembly is shown in a detached state 1 in FIG. 1 and in an attached state 2 in FIG. 2. In the attached state 2, the first sub-assembly 12 and the second sub-assembly 13 are in contact with the circuit carrier 11. The compliant pins 13-3 of the second sub-assembly 13 detachably attach with the through holes of the circuit carrier 11 perpendicularly to the direction of the electrical leads 14 on the circuit carrier 11, so as to establish a contact with the first sub-assembly 12. The compliant pins 12-1, 13-3 are electronic connectors that are suitable for detachably joining the first sub-assembly 12 and the second sub-assembly 13.

Action-pin, multispring, and eye of needle are used to connect the first sub-assembly 12 and the second sub-assembly 13 with the circuit carrier 11. Such compliant pins are less prone to fretting compared to commonly used Blade/receptacle compliant pins.

The assembly allows magnetic terminals and quick disconnects to be easily and effectively connected to the circuit carrier 11. In so doing, harnesses may be easily disconnected and reconnected to allow for ease of repair or replacement of the individual components. Furthermore, such an assembly also obviates the need of soldered connection and thereby provides a compact and an automated solution for transforming the power.

The above explanations are examples of embodiments of the present disclosure, and the scope of the present disclosure is not limited thereto. For example, in the above explanation about the embodiments, the present disclosure is applied to the telecommunication devices. However, the present disclosure is not limited thereto. The present disclosure can be applied to any suitable power source that transfer power to a coil. The embodiments of the present disclosure using compliant pin variants can eliminate soldering processes and offers a compact solution that can be automated. Such an assembly needs minimal intervention.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

While the present disclosure has been, in particular, shown and described with reference to exemplary embodiments thereof, it will be understood by those skilled in the art that various changes in form and details may be made therein without departing from intent of the disclosure as defined by the appended claims. The exemplary embodiments should be considered in descriptive sense only and not for purposes of limitation. Therefore, the scope of the present disclosure is defined not by the above description of the invention but by the appended claims, and all differences within the scope will be construed as being included in the present invention.

What is claimed is:

1. An assembly, comprising:

a circuit carrier having a first surface and a second surface opposite to the first surface;

a first sub-assembly detachably connected to the first surface of the circuit carrier, the first sub-assembly having a plurality of compliant pins; and a second sub-assembly detachably connected to the second surface of the circuit carrier, the circuit carrier has an electrically conductive lead interconnecting the plurality of complaint pins of the first sub-assembly and a compliant pin of the second sub-assembly.

2. The assembly of claim 1, wherein each of the compliant pins of the first sub-assembly and the second sub-assembly engages a plated through hole on the circuit carrier and is electrically connected to the plated through hole.

3. The assembly of claim 1, wherein the second sub-assembly includes a cavity and a receptacle.

4. The assembly of claim 3, wherein the cavity is a plastic material.

5. The assembly of claim 3, wherein the compliant pin of the second sub-assembly protrudes perpendicular to the receptacle.

6. The assembly of claim 5, wherein the complaint pin of the second sub-assembly is connected perpendicularly to the conductive lead on the circuit carrier.

7. The assembly of claim 3, wherein the second sub-assembly receives a conductor.

8. The assembly of claim 7, wherein the receptacle establishes electrical contact by displacement of an insulation on the conductor.

9. The assembly of claim 1, wherein the first sub-assembly has a fin adapted to connect with a mating contact.

10. The assembly of claim 1, wherein the circuit carrier is a printed circuit board.

11. The assembly of claim 1, wherein the first sub-assembly is a flat tab.

* * * * *